United States Patent [19]

Basey

[11] Patent Number: 4,533,121

[45] **Date of Patent: * Aug. 6, 1985**

[54] VARIABLE PITCH STAIR RAILING ASSEMBLY

[75] Inventor: Gene Basey, 18447 Santar, Rowland Heights, Calif. 91748

[73] Assignee: Gene Basey, LaPuente, Calif.

[ * ] Notice: The portion of the term of this patent subsequent to Aug. 17, 1999 has been disclaimed.

[21] Appl. No.: 348,970

[22] Filed: Feb. 16, 1982

Related U.S. Application Data

[63] Continuation-in-part of Ser. No. 157,186, Jun. 6, 1980, Pat. No. 4,352,485.

[51] Int. Cl.[3] ..... E04H 17/14

[52] U.S. Cl. ..... 256/67; 256/59

[58] Field of Search ..... 403/292, 295; 256/59, 256/65, 66, 67

[56] References Cited

U.S. PATENT DOCUMENTS

| | | | |
|---|---|---|---|
| 1,772,159 | 8/1930 | Roth | 256/65 |
| 2,654,579 | 10/1953 | Cremens | 256/65 X |
| 2,855,227 | 10/1958 | Bottom | 256/21 X |
| 3,306,586 | 2/1967 | Green | 256/67 X |
| 4,272,061 | 6/1981 | Suckno | 256/67 |
| 4,352,485 | 10/1982 | Basey | 256/67 X |

FOREIGN PATENT DOCUMENTS

| | | | |
|---|---|---|---|
| 2013449 | 9/1971 | Fed. Rep. of Germany | 256/65 |
| 545043 | 7/1922 | France | 256/65 |
| 1315972 | 5/1973 | United Kingdom | 403/292 |

*Primary Examiner*—Andrew V. Kundrat

*Attorney, Agent, or Firm*—Poms, Smith, Lande & Rose

[57] ABSTRACT

A wooden stair rail assembly having a wooden handrail, a wooden shoe rail, and wooden balusters, is provided with a limited range of movement from about 29 degrees to 43 degrees, to accommodate the normal range of variations in the inclination or pitch of stairways. The ends of the balusters are provided with axially extending pins which engage the handrail and the shoe rail. The handrail and the shoe rail are provided with recesses into which the ends of the balusters extend, and clearance between the balusters and the rails is provided to permit the pins to flex so that the balusters may remain vertical despite the change in inclination of the handrail and the shoe rail. The pins are of high strength material having a low elastic limit and the quality of remaining deformed after having been bent, so that the assembly will retain its "racked" configuration once it has been shifted to the desired angle of inclination. Polyvinyl chloride plastic provides suitable mechanical properties for the dowels or pins. A thermo-setting glue, and additional wood fillets which may be positioned in longitudinally extending recesses, particularly in the shoe rail, complete the mechanical assembly, apart from the newel posts at the ends of the stair rail.

20 Claims, 10 Drawing Figures

FIG. 9
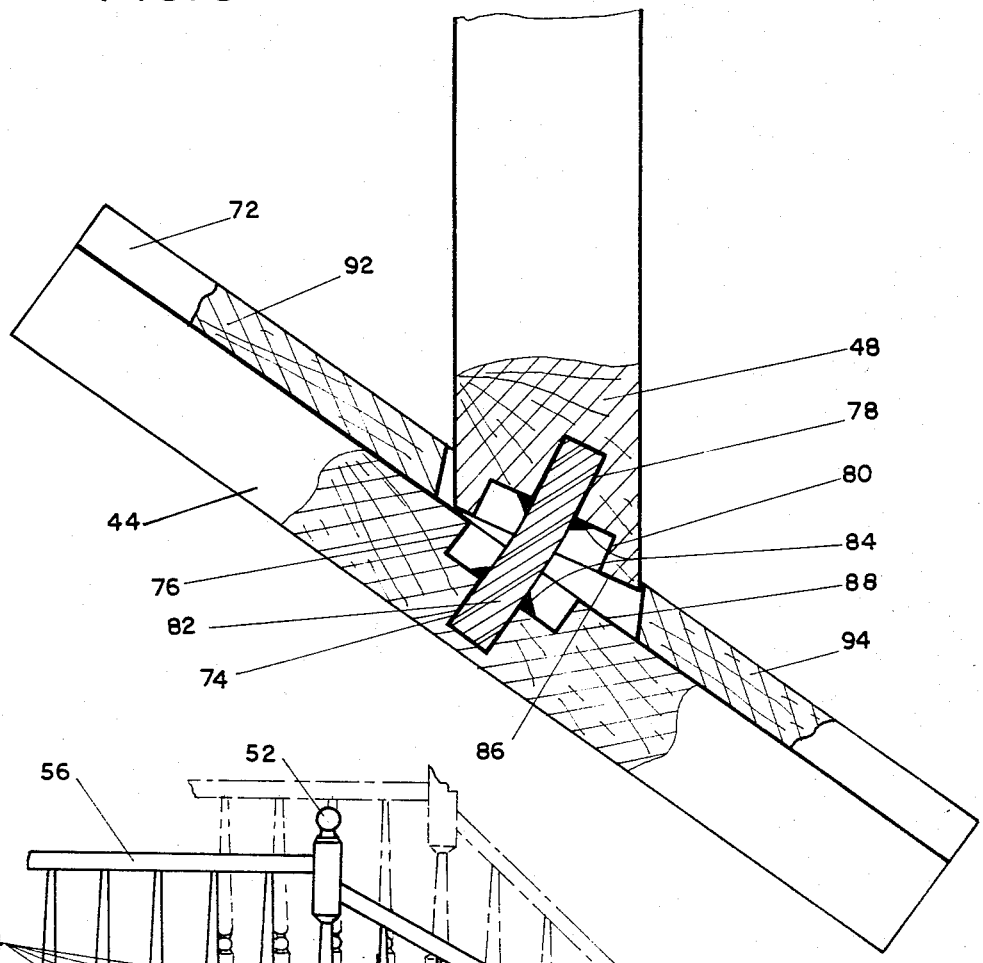
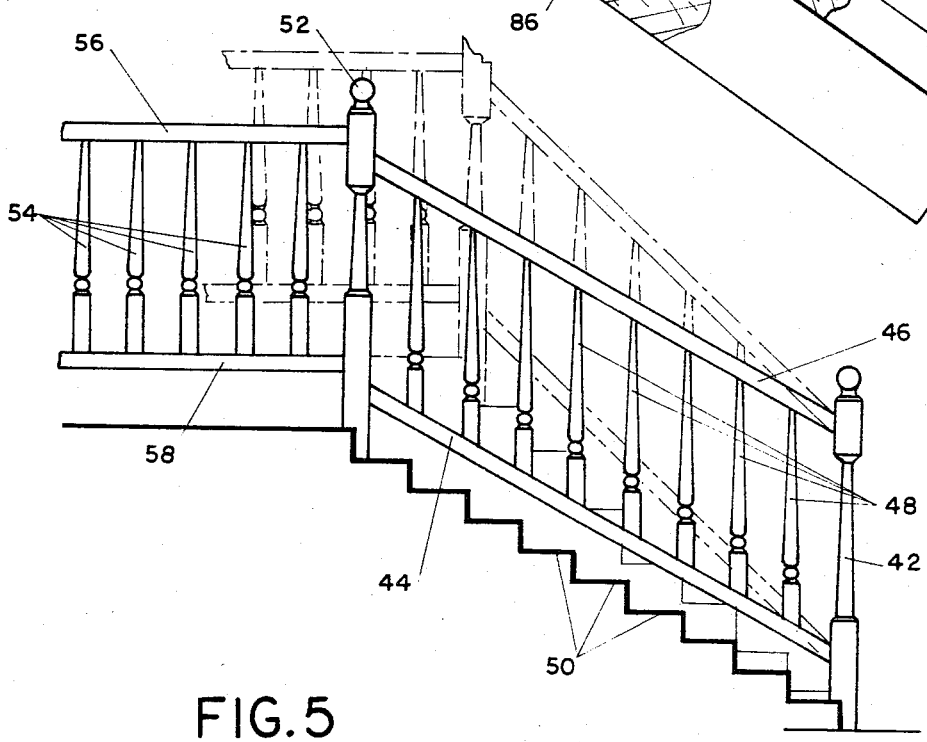
FIG. 5

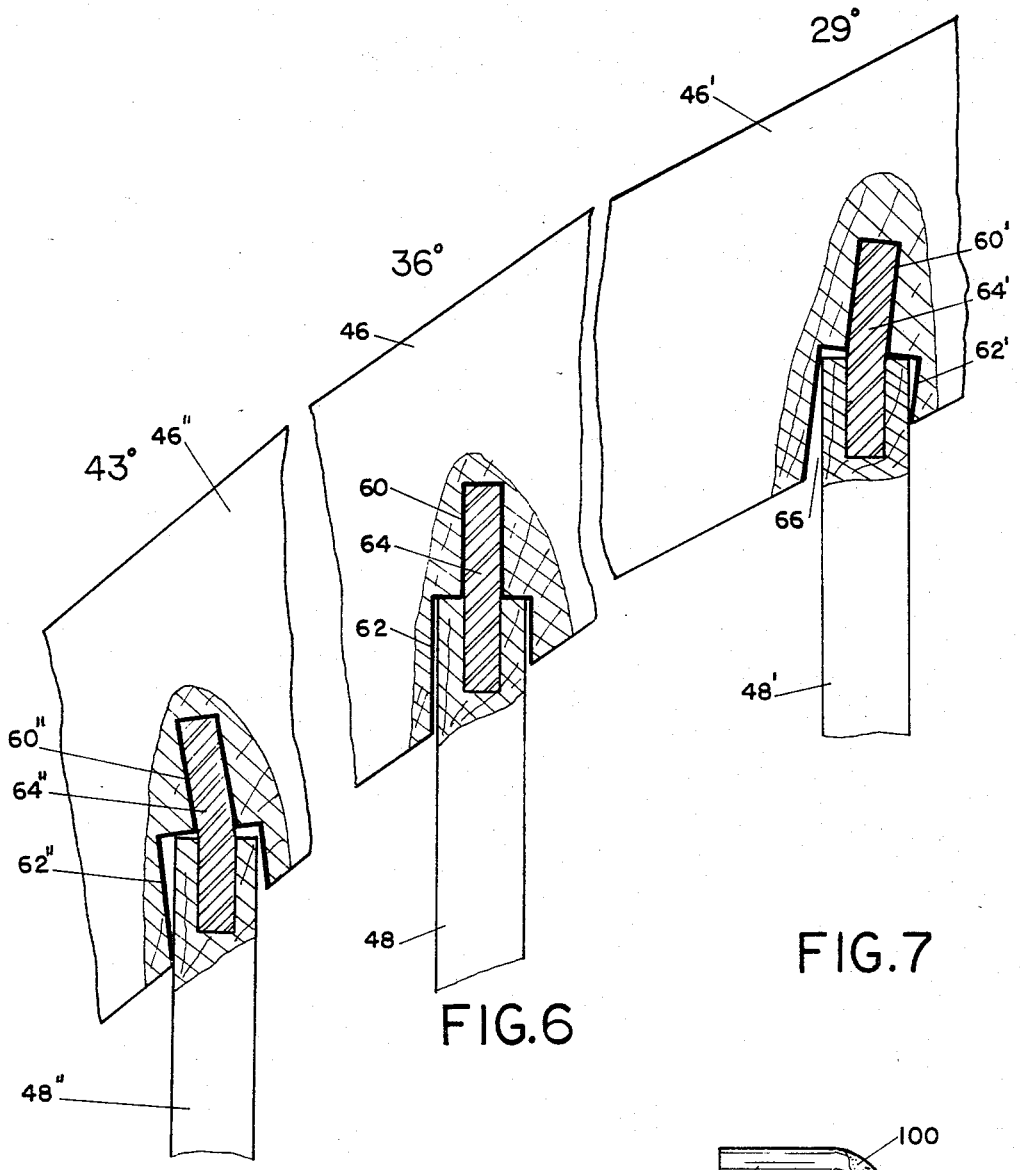
FIG.6
FIG.7
FIG.8
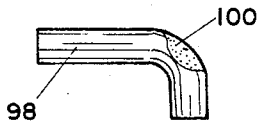
FIG.10

VARIABLE PITCH STAIR RAILING ASSEMBLY

This patent application is a continuation-in-part of my prior U.S. patent application Ser. No. 157,186, filed June 6, 1980 and now U.S. Pat. No. 4,352,485.

FIELD OF THE INVENTION

This invention relates to variable pitch stair rail or balustrade assemblies.

BACKGROUND OF THE INVENTION

Stairways vary in their pitch from about 29 degrees up to about 43 degrees, with the normal stairway having a pitch or angle of inclination of about 36 degrees. Because of these variations in the pitch or inclination of stairs, it is difficult to make a satisfactory preassembled wooden stair rail or balustrade. In this regard certain metal assemblies have been proposed which permit changing of the pitch; however these are generally relatively unstable and unsightly. Further, in the field of variable inclination wooden stair rail assemblies, reference made to Howard Suckno U.S. Pat. No. 4,272,061, granted June 9, 1968. However, the assembly shown in this patent has serious shortcomings, particularly in view of the transverse orientation of the pins upon which the rail pivots, and the resulting problems presented by this construction. Specifically, the transverse pins in the stair rail are unsightly, and result in a very weak and unstable assembly, so that if a person chances to exert some pressure with his foot on the shoe rail, the pin is likely to split out of the shoe rail and permanently destroy the stair rail assembly. For these reasons, the producers of the Suckno variable pitch railing recommend that the shoe rail be supported by extra blocks between the shoe rail and the stairs at intervals along its length. Another shortcoming of the Suckno arrangement is its intended applicability to both horizontal runs and also to inclined stair railings. With the same distance between pivot points on the shoe rail and the handrail, the spacing between the balusters is reduced on the inclined sections of the stair rail assembly as compared to on the horizontal sections, and this significant variation runs contrary to architectural practices and aesthetic appearances, thereby further detracting from the appearance of the complete stair railing installation. Accordingly, both from an aesthetic point of view because of the improper baluster spacing and the appearance of the pivot points extending through the sides of the handrail and the shoe rail, as well as from a mechanical point of view, with the mechanical weakensses mentioned hereinabove, the Suckno units are wholly unsatisfactory for high quality residential or business usage.

A principal object of the present invention is, therefore, to provide a high quality variable pitch wooden or solid railing or balustrade assembly which overcomes the problem mentioned hereinabove with regard to the Suckno system. More specifically, the unsightly pivot points should not appear in the railing, the spacing between the balusters in both horizontal and vertical sections should be substantially the same, and the units should have high strength and rigidity comparable to a conventional completely custom installation.

SUMMARY OF THE INVENTION

In accordance with the present invention the foregoing objects are achieved by the use of a stair rail assembly wherein the balusters are provided with longitudinally extending pins at both ends which extend into the handrail and the shoe rail, while the handrail and shoe rail provide recesses including clearances permitting racking or deflection of the assembly from a normal inclination between 30 and 40 degrees, by a predetermined limited angle such as 7 or 10 degrees, while concealing the ends of the balasters.

Preferably, the pins should be made of a high strength material having a low elastic limit, and with the pins retaining their deformed configuration after having been bent.

The recesses in the handrail and the shoe rail may extend longitudinally along the length of the rails, with the rectangular ends of the balusters extending into these recesses and being spaced slightly from the bottom of the recess to permit the desired angular shifting of the position of the baluster by 5 or 10 degrees in either direction from its normal orientation.

In accordance with another feature of the invention, the handrail or the shoe rail may be provided with a two-step hole so that glue around the securing pin may remain in the enlarged hole, while the pin itself is glued into the deeper hole.

Using the two-step hole arrangement in the handrail, tapered balusters having a relatively small diameter circular upper end may be fitted into the larger recess with a significant tolerance such as 1/32 of an inch between the periphery of the baluster and that of the enclosing larger circular recess or counterbore in the handrail, so that shifting of the angle of the baluster relative to the handrail will be readily permitted.

It is particularly to be noted that, instead of the transverse pivot pins of the Suckno type, one aspect of the invention involves the use of pins extending parallel to the stairway assembly and passing into the extreme end surface of the balusters, in combination with clearance between the ends of balusters and the hand and shoe rails to permit racking of the units to variable angles.

It may also be noted that the two step hole configuration may be present both at the bottom of the longitudinal recesses and also in the ends of the baluster, and this is particularly useful in cases where the ends of the balusters are square, and relatively large as compared with the tapered upper ends of certain types of balusters.

Other objects, features and advantages of the invention will become apparent from a consideration of the following detailed description and the accompanying drawings.

BRIEF DESCRIPTION OF THE DRAWINGS

FIG. 5 is a side view of an alternative embodiment of the invention showing both an inclined stair railing section and also a horizontal section;

FIGS. 6, 7 and 8 are cross-sectional views showing arrangements for securing the upper ends of a tapered baluster into a handrail;

FIG. 9 shows an alternative arrangement for securing the rectangular end of a baluster into either a handrail or a shoe rail; and FIG. 10 shows a pin of one type which may be employed in the present invention, bent to an extreme angle.

DETAILED DESCRIPTION

Figure 1:
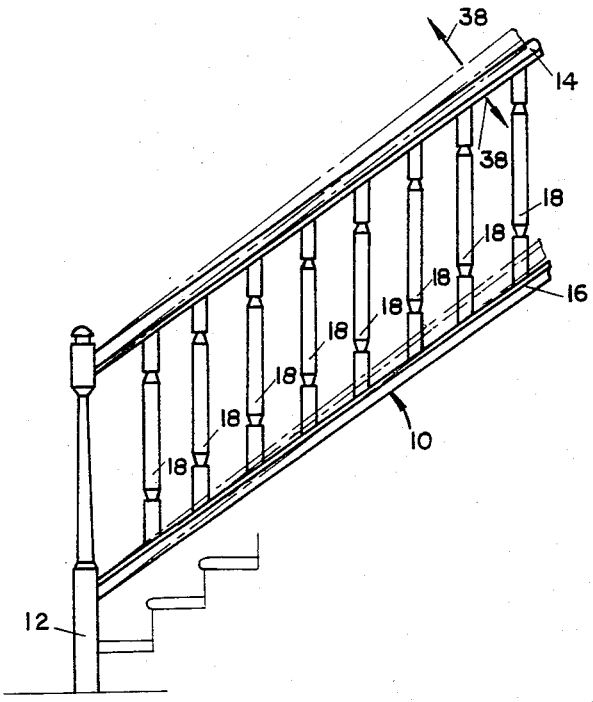
FIG. 1 is a side view of a stair rail assembly in accordance with a first illustrative embodiment of the invention.
Figure 2:
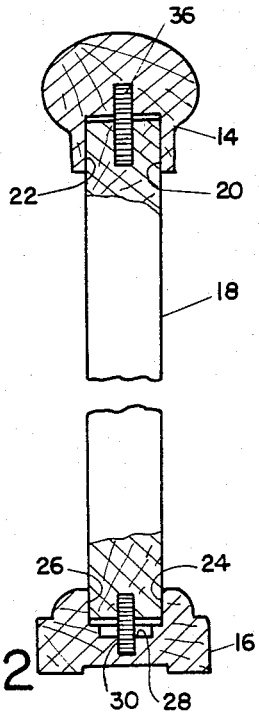
FIG. 2 is a front elevational view in partial cross section of one of the balusters shown in FIG. 1 and the cooperating shoe and handrails.
Figure 3:
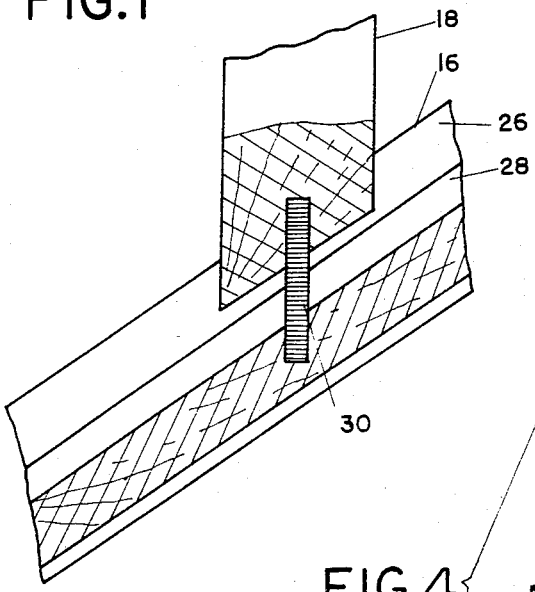
FIG. 3 is a side elevation view in partial cross section of a portion of the assembly of FIG. 1.
Figure 4:
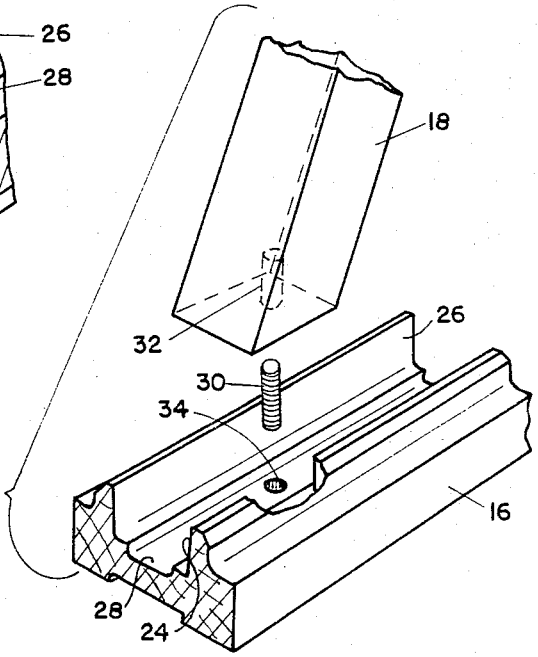
FIG. 4 is an exploded isometric view of the assembly of FIG. 3.

Referring now to FIGS. 1, 2, 3 and 4, there is shown a variable rake stair rail assembly 10 which includes a starting newel 12, a handrail 14, and a shoe rail 16. A plurality of balusters 18 are disposed in generally parallel relationship and extend intermediate the shoe rail 16 and the handrail 14. The handrail 14 has a longitudinally extending recess or channel having generally parallel and generally planer opposed sides 20 and 22. The sides 20, 22 of the channel or recess in the handrail engage the side of the rectangular or square upper axial extremity of the baluster 18, as shown in FIG. 2. In a similar manner, as shown in FIGS. 3 and 4, the shoe rail has an elongated recess or channel with generally planer and generally parallel opposed sides 24 and 26, and these sidewalls engage the sides of the rectangular lower axial extremity of each baluster 18. In one form of the invention the channel defined by the sides 24, 26 includes an additional elongated recess 28 which extends along the length of the shoe rail 16 generally parallel thereto, at the bottom of the main recess. As best shown in FIG. 2, the sides of the channel in the shoe rail 16 have a generally step-shaped contour.

Each baluster 18 is secured to the shoe rail 16 by a dowel or pin 30 which engages a hole 32 in baluster 18 and a hole 34 in the shoe rail 16. In a similar manner, a dowel or pin 36 extends between the handrail 14 and the upper axial extremity of the baluster 18. Preferably the pins or dowels 30 will be glued in place by a thermosetting glue, with excess glue flowing into the recess 28. The application of the thermo-setting glue will normally occur in the factory, and the glue will normally not directly engage the sidewalls of the rectangular ends of the balusters 18, so that shifting of the angular orientation of the balusters relative to the shoe and handrail may still be accomplished readily.

As shown by the arrows 38 in FIG. 1, the angle between the balusters 18 and the handrail 14 and shoe rail 16 is variable to facilitate installation of the apparatus on stairways having a wide variation in steepness. As mentioned hereinabove, the normal average angle of inclination of residential stairways is 36 degrees, but variations of this standard angle range from approximately 29 degrees up to approximately 43 degrees, or about 7 degrees above and below the normal pitch or angle of inclination. In some rare cases this may be as much as 10 degrees or more, but these are exceptional cases. As shown in FIGS. 2 and 3, the pins or dowels are mounted so that clearance is provided between the baluster and the bottom of the recess in the shoe and handrail to permit the limited relative angular movement in either direction of the balusters relative to the rails.

The pins such as pins 30 and 36 may be ridged as shown, or may have a smooth outer surface as indicated in FIGS. 6 through 10 of the drawings. The pins are preferably formed of high strength material having strength comparable to or preferably substantially greater than the wooden handrails, shoe rails, and balusters, and of a material which will be bonded securely in place by the thermo-setting glue. The pins are of a suitable material such as polyvinyl chloride which has a very low elastic limit so that the pins are easily permanently deformed when bent. When such material is employed, the assembly retains its deformed or "racked" configuration, and does not exert a significant restoring force to the assembly which might otherwise cause installation and permanency problems.

FIG. 5 shows an alternative embodiment of the invention employing balusters having their upper ends tapered, and showing a full range of angular adjustment from 29 degrees to 43 degrees in pitch. In FIG. 5, the assembly includes the starting newel 42, the shoe rail 44, the handrail 46 and the balusters 48. The relatively long shallow stairway is indicated at reference numeral 50. An additional newel post 52 is located between the inclined and the horizontal sections of the stair rail. The balustrade or upper horizontal section of the stair rail assembly includes the balusters 54 and the shoe and handrails 58 and 56, respectively.

FIG. 6 shows the mode for securing a tapered baluster 54 into the handrail 56. First, a two-step hole is formed, having a deep portion 60 of reduced diameter, and an outer counterbored portion 62 of larger diameter. These holes are drilled at an angle of approximately 36 degrees relative to a perpendicular to the handrail 46. In addition, the counterbored hole 62 has a diameter of approximately $\frac{5}{8}$", while the end of the baluster 48 has a circular cross section of approximately 9/16". This provides a clearance of approximately 1/32" between the periphery of the end of the baluster 48 and the counterbore 62. An axial hole is drilled in the end of the baluster 48, and the baluster is secured in place using a pin 64 of the type described hereinabove, and suitable thermo-setting glue. The amount of glue is carefully controlled so that it does not extend significantly into the clearance space between the curved surfaces at the end of the baluster 48 and the side walls of the counterbored hole 62.

FIG. 7 shows the configuration of the baluster 54' in its vertical orientation, when the handrail 48' is at a more shallow orientation, such as 29 degrees, relative to the horizontal. In this case, the junction between the reduced diameter end of the baluster and the bottom of the counterbore 62', together with the pin or dowel 64', form a pivot for the baluster, with the clearance around the end of the baluster permitting some tilting as shown. With the space 66 being located under the handrail 46', and immediately adjacent to baluster, it is not noticeable, and it may be further concealed by a slight downward lip which is present on many handrails at their outer edges.

FIG. 8 is a view which is similar to that of FIG. 7, but shows a handrail 46" which is relatively steep, making an angle of perhaps 43 degrees with the horizontal, and the vertical baluster 48" is therefore tilted in the opposite direction relative to the handrail 46" as compared with FIG. 7. Again, the clearance as mentioned above between the curved side walls at the upper end of the baluster 48" and the counterbore 62" permits this tilting without damage to the baluster or to the handrail.

Referring to FIG. 9, it shows the square end of a baluster 48 extending into a recess 72 in a rail 44 which is preferably a shoe rail. The shoe rail 44 is provided with a two-step hole having a small deep hole 74 and a more shallow counterbore 76 of larger diameter, at the bottom of recess 72. Similarly, the lower end of the baluster 48 has a two-step hole with the deeper hole of small diameter being designated by the reference numeral 78 and the shallow counterbore of larger diameter being designated by the reference numeral 80. The dowel or pin 82 is glued by suitable thermo-setting glue into the holes 74 and 78 in the shoe rail, and the baluster, respectively. The counterbores provide a space for the excess glue 84 without engagement between the side surfaces of the end of the baluster and the recess 72. The baluster 48 is shown tilted and is accommodating a relatively steep angle, such as 43 degrees, for the shoe rail 58. Under normal conditions, with the shoe rail at an angle of 36 degrees relative to the horizontal, there would be a constant spacing between the lower surface 86 of the baluster and the bottom 88 of the recess 72, and this would be approximately equal to $\frac{1}{8}$ inch. When the baluster 54 is tilted as shown, with one edge barely touching the bottom 88 of the recess 72, the other corner of the baluster is spaced apart by approximately $\frac{1}{4}$ inch from the bottom surface 88 of recess 72. The depth of the recess 72 is slightly greater than $\frac{1}{4}$ inch, and is preferably about 11/32 inch in depth. Similarly, for relatively shallow angular orientations of the shoe rail, the baluster would be tilted in the opposite direction relative to the shoe rail.

Also shown in FIG. 9 are the wood fillets 92 and 94 which extend into the recess 72, and which also extend from one baluster to the next adjacent baluster. The wood fillets are preferably also about 11/32 inch thick. These wood fillets 92 and 94 are glued into position, following on-site installation of the preassembled stair rail unit, and serve to give additional stability and rigidity to the assembly, as well as concealing the lower ends of the baluster and the slight spacing between the ends of the balusters and the bottom of the recess 72. Such fillets are also used in the assembly of FIG. 1, but are not shown in FIGS. 3 and 4, for ease and clarity of description.

It may therefore be noted that the clearance between the lower surfaces 86 of the balusters 48 and the bottom 88 of the recess 72 serves the same function as the clearance between the curved surfaces of the reduced sized upper ends of tapered balusters and the enclosing counterbores, as shown in FIGS. 6, 7 and 8. Specifically, in each case, the clearances permits angular racking of the assembly while maintaining high structural integrity of the entire unit, as a result of the $\frac{1}{4}$ inch dowel pins which are firmly glued into the shoe and handrails and into the ends of the balusters. Further, with the low elastic limit of the pins, they quickly assume a new "set" and exert no force on the entire assembly tending to restore it to its original 36-degree configuration.

It may also be noted that the counterbores 62 as shown in FIGS. 6, 7 and 8 constitute recesses performing much the same function as the longitudinally extending recess included in the handrail 14 as shown in FIG. 2, for example. In each case the recess or recesses substantially conceal the deflection and spacing at the ends of the balusters. It may also be noted that the depth of the holes and the length of the pins or dowels are carefully controlled to provide the desired engagement (see FIG. 6) or spacing (see FIG. 9) between the baluster ends and the adjacent surfaces of the rails.

In the arrangements as shown herein, the orientation of the dowels or pins is parallel to the overall plane of the stair railing assembly, which will correspond to the vertical, and the pins extend through the extreme end surfaces at each end of each baluster. This is in contrast to the transverse orientation of the hinge or pivot pins of assemblies such as those disclosed in the Suckno patent cited hereinabove.

It may also be noted that, when balusters are employed with rectangular upper and lower ends as shown in FIGS. 1 through 4, the fillets may be provided both on the handrail and the shoe rail, and the configuration as shown in FIG. 9 with the two-step holes, may advantageously be employed both in the securing of the balusters 18 to the handrail 14 and to the shoe rail 16, as shown in FIG. 1.

FIG. 10 is included by way of interest to illustrate the properties of the dowels or pins which are preferably employed in the implementaion of the present invention. These pins are preferably in the order of $\frac{1}{4}$ inch in diameter and approximately $1\frac{1}{2}$ inches in length. When they are bent, they retain their bent configuration, as a result the low elastic limit of the material which is used. In one case, where a polyvinyl chloride pin was employed, it was bent as indicated in FIG. 10 to a much greater angle than the 7 degrees or so which would normally be involved in the actual racking of a stairway or balustrade assembly. The pin 98 as shown in FIG. 10 was held with a pair of pliers at its smaller end, and bent over as indicated. The polyvinyl chloride pin was initially dark grey in color over its entire outer periphery. Following deflection and the permanent set as indicated in FIG. 10 the outer portion 100 assumed a color which was a slightly lighter grey, than that of the remainder of the pin. It was quite interesting to note that the plastic did not spring back to its original configuration, but had a very low elastic limit and seemed to take set at the angle to which it was bent. Incidentally, by way of an exhibit at a trade show, a stair rail assembly similar to those shown in the present drawings, and using pins of the type described hereinabove, was racked back and forth by 7 degrees in each direction from a neutral position for many thousands of times, before failure.

With regard to the pins, as noted above it is desired that they have high strength, and also that they have a low elastic limit so that they will retain their new orientation following bending. In addition to the polyvinyl chloride material, other materials with comparable mechanical properties may be used. Suitable materials with high strength fibres or moleular chains loosely bonded together, and having high internal friction, for example, may be used instead of the polyvinyl chloride pins or dowels.

For completeness, certain illustrative dimensions will now be mentioned. Initially, the baluster may come in various lengths or dimensions, with the most common lengths being $26\frac{1}{2}$ inches and 31 inches with the square portions of the balusters normally being $1\frac{1}{4}$ inches on a side, or $1\frac{5}{8}$ inches on a side for the larger balusters. The upper ends of the tapered baluster may be in the order of $\frac{1}{2}$ inch or 9/16 inch in diameter, and the counterbored hole about $\frac{5}{8}$ inch in diameter for the tapered baluster, to give 1/32 inch clearance around the end of the baluster. The fillets are normally made flush with the upper surface of the shoe rail, with the depth of the recess 72 in FIG. 9, and the height of the fillet both being approximately 11/32 inches. With the surface 86 having a maximum deflection away from the bottom 88 of the recess 72 of $\frac{1}{4}$ inch, the fillets are approximately 3/32 inch thicker than the maximum gap, and therefore consistently conceal the space. The counterbores 76 and 80 in FIG. 9, may for example be $\frac{1}{4}$ inch deep and $\frac{7}{8}$ inch in diameter. Many of these dimensions are not critical, and slightly larger or smaller dimensions may often be emloyed.

Incidentally, the manufacturing operations in forming the horizontal sections of the balustrade are substantially the same as those for manufacturing the inclined sections, with the exception that the surfaces of certain holes or baluster ends in the inclined section are oriented at an angle of 36 degrees relative to perpendicularity with the mating part, and are parallel to and spaced from the adjacent surface of the baluster or rail. On the other hand, the holes in the horizontal section of the stairway assembly are precisely aligned with axis of the baluster and transverse to the axis of the hand and shoe rails. Also the ends of the balusters are square in the horizontal sections. In addition, the spacing between the holes in the handrail and the shoe rail is slightly less in the horizontal section than in the inclined section of the stair rail assembly. More specifically, it has been determined that using a six-inch spacing between the holes in the horizontal section, a spacing of approximately 7 inches between holes in the handrail and shoe rail in the inclined section, will result in a spacing between vertical balusters in the inclined section which will closely approximate the spacing between the balusters in the horizontal section. Similarly, when a 7 inch spacing is employed for the balusters in the horizontal section, a spacing of approximately 8 inches between holes in the handrail and shoe rail for the inclined section produces substantially the same horizontal spacing between vertical balusters in both sections. Using these manufacturing techniques, the aesthetic appearance of the entire assembly including inclined and horizontal sections is maintained, in contrast to the displeasing appearance produced by certain prior assemblies as mentioned hereinabove, where a single spacing along the handrails and shoe rails is employed for both the horizontal and inclined sections of the stair rail assembly, resulting in different horizontal spacing in the two sets of balusters.

It is again noted that the approach involved in the present invention involves providing only a limited angular adjustment of stair rail assemblies, of only about fourteen degrees, instead of trying to provide a full range of adjustment from horizontal to maximum inclination. When the latter approach has been adopted, the result has generally been an ugly, weak, and rattling or loose construction. On the other hand by providing glued, dowelpin joints and limited angular adjustment, the result is a solid, mechanically sound, asethetically pleasing and easily installed stair rail assembly, which has the appearance and qualities of full custom installations.

In conclusion, it is to be understood that the embodiments of the invention disclosed in the drawings and described in detail hereinabove are illustrative of the principles of the invention. It is to be understood that various mechanical changes may be included in the structure without departing from the spirit and scope of the invention. Thus, by way of example but not of limitation, instead of using wood for the handrail, shoe rail, and balusters, plastic materials such as fiber glass reinforced plastic, or other structural plastic materials could be employed to form a solid non-metallic stair rail assembly. In addition, as noted above, instead of using polyvinyl chloride pins, other materials of high strength, low elastic limit, and having good bonding qualities with glue, could be employed; alternatively, using molded plastic or fiber glass balusters, the pins may be formed integrally with the balusters. Accordingly, the present invention is not limited to that shown in the drawing and described in the detailed descriptions.

What is claimed is:

1. A stair rail assembly which may be varied in its mounting angle from a neutral orientation of approximately 36 degrees by a predetermined angle up to about 10 degrees in either direction comprising:

a wooden handrail, a wooden shoe rail, wooden balusters extending between said handrail and said shoe rail, means, including a pin extending into each end surface of each said baluster and into said shoe and handrails, for securing said balusters to said shoe and handrails, said pins having their longitudinal axis extending generally parallel to a vertical plane and to the plane of the overall stair rail assembly;

said pins being of high strength, having a very low elastic limit, and being permanently deformed when bent;

said handrail and said shoe rail being provided with recesses for receiving the ends of said balusters, and having additional holes at the bottoms of said recesses for receiving said pins; and means for mounting said ends of said balusters in said recesses with clearance permitting angular movement of said balusters in said recesses and relative to said hand and shoe rails by said predetermined angle;

whereby said assembly may be racked to a different mechanically stable inclination within said predetermined angle, with said balusters remaining vertical, with said pins holding their new orientation, and with said recesses substantially concealing the small angular displacement of the ends of said balusters relative to said rails.

2. A stair rail as defined in claim 1 wherein said shoe rail is provided with a longitudinally extending recess receiving the lower end of each of said balusters.

3. A stair rail assembly as defined in claim 2 wherein wooden fillets are mounted in said longitudinally extending recess between adjacent balusters.

4. A stair rail assembly as defined in claim 1 wherein said balusters are tapered and have upper ends of a circular reduced cross section, and wherein said recesses in said handrail are circular and have a clearance around the upper ends of said baluster to permit angular shifting of said balusters relative to said handrail by an angle up to said predetermined angle.

5. A stair rail assembly as defined in claim 1 wherein said pins are formed of polyvinyl chloride.

6. A stair rail assembly as defined in claim 2 wherein the bottom end of each of the balusters is provided with a two-step hole, including a central deep hole of small diameter and a larger counterbored hole, and two-step holes are also provided in the bottom of said longitudinally extending recess in said shoe rail, whereby said pins may be glued into the smaller holes in said baluster and said shoe rail with excess glue being held in the larger counterbored hole, and no glue will extend outside of said two-step holes.

7. A stair rail assembly as defined in claim 1 wherein said assembly includes structural means associated with an end of each baluster and one of said rails for orienting said balusters and rail at approximately 36 degrees relative to perpendicularity with respect to the other and with adjacent surfaces being parallel but with sufficient clearance to permit deflection of said balusters by said predetermined angle without damaging either said balusters or said rail.

8. A stair rail assembly as defined in claim 1 wherein thermo-setting glue means are provided for securing said pins to said balusters and to said rails.

9. A stair rail assembly which may be varied in its mounting angle from a neutral orientation of between 30 and 40 degrees by a predetermined angle up to about 10 degrees in either direction comprising:

a solid non-metallic handrail, a solid non-metallic shoe rail, solid non-metallic balusters extending between said handrail and said shoe rail, means, including a pin secured to each end of each said baluster and extending into said shoe and handrails, for securing said balusters to said shoe and handrails, said pins having their longitudinal axis extending generally parallel to a vertical plane and to the plane of the overall stair rail assembly;

said pins being of high strength, having a very low elasic limit, and being permanently deformed when bent;

said handrail and said shoe rail being provided with recesses for receiving the ends of said balusters, and having additional holes at the bottoms of said recesses for receiving said pins; and means for mounting said ends of said balusters in said recesses with clearance permitting angular movement of said balusters in said recesses and relative to said shoe and handrails by said predetermined angle;

whereby said assembly may be racked to a different mechanically stable inclination within said predetermined angle, with said balusters remaining vertical, with said pins holding their new orientation, and with said recesses substantially concealing the small angular displacement of the ends of said balusters relative to said rails.

10. A stair rail as defined in claim 9 wherein said shoe rail is provided with a longitudinally extending recess receiving the lower end of each of said balusters.

11. A stair rail assembly as defined in claim 10 wherein fillets are mounted in said longitudinally extending recess between adjacent balusters.

12. A stair rail assembly as defined in claim 9 wherein said balusters are tapered and have upper ends of a reduced circular cross section, and wherein said recesses in said handrail are ciruclar and have a clearance around the upper ends of said baluster to permit angular shifting of said balusters relative to said handrail by an angle up to said predetermined angle.

13. A stair rail assembly as defined in claim 9 wherein said pins are formed of polyvinyl chloride.

14. A stair rail assembly as defined in claim 9 wherein said assembly includes structural means associated with each end of each baluster and said rails for orienting said balusters and rails at approximately 36 degrees relative to perpendicularity to the longitudinal axis of the other and with adjacent surfaces being substantially parallel but with sufficient clearance to permit deflection of said baluster by said predetermined angle without damaging either said baluster or said rail.

15. A stair rail assembly which may be varied in its mounting angle from a neutral position of approximately 36 degrees by a predetermined angle up to about 10 degrees in either direction comprising:

a wooden handrail, a wooden shoe rail, wooden balusters extending between said handrail and said shoe rail, means, including a pin extending into each end surface of each said baluster and into said shoe and handrails, for securing said balusters to said shoe and handrails, said pins having their longitudinal axis extending generally parallel to a vertical plane and to the plane of the overall stair rail assembly;

said handrail and said shoe rail being provided with recesses for receiving the ends of said balusters, and having additional holes at the bottoms of said recesses for receiving said pins, said recesses and said additional holes forming a two-step hole configuration including a counterbore of shallow depth and larger diameter enclosing said pin receiving hole, and means for mounting said ends of said balusters in said recesses with clearance permitting angular movement of said balusters in said recesses and relative to said show and handrails by said predetermined angle;

whereby said assembly may be racked to a different mechanically stable inclination within said predetermined angle, with said balusters remaining vertical, with said pins holding their new orientation, and with said recesses substantially concealing the small angular displacement of the ends of said balusters relative to said rails.

16. A stair rail as defined in claim 15 wherein said shoe rail is provided with a longitudinally extending recess receiving the lower end of each of said balusters.

17. A stair rail assembly which may be varied in its mounting angle from a neutral orientation between 30 and 40 degrees by a predetermined angle up to about 10 degrees in either direction comprising:

a solid non-metallic handrail, a solid non-metallic shoe rail, balusters extending between said handrail and said shoe rail, means, including a dowel pin extending into each end surface of each said baluster and into said shoe and handrails, for securing said balusters to said shoe and handrails, said pins having their longitudinal axes extending generally parallel to a vertical plane and to the plane of the overall stair rail assembly;

said handrail and said shoe rail being provided with recesses for receiving the ends of said balusters, and having additional holes at the bottoms of said recesses for receiving said pins; and means for mounting said ends of said balusters in said recesses with clearance permitting angular movement of said balusters in said recesses and relative to said shoe and handrails by said predetermined angle;

whereby said assembly may be racked to a different mechanically stable inclination within said predetermined angle, with said balusters remaining vertical, and with said recesses substantially concealing the small angular displacement of the ends of said balusters relative to said rails.

18. A stair rail assembly as defined in claim 17 wherein said balusters are tapered and have upper ends of a circular reduced cross section, and wherein said recesses in said handrail are circular and have a clearance around the upper ends of said baluster to permit angular shifting of said balusters relative to said handrail by an angle up to said predetermined angle.

19. A stair rail assembly as defined in claim 17 wherein said pins are formed of polyvinyl chloride rods.

20. A stair rail assembly as defined in claim 17 wherein said handrail and said shoe rail both include two-step holes, and said pins are glued into the deepter holes or reduced diameter.

* * * * *